US010376941B2

(12) United States Patent
Wada et al.

(10) Patent No.: US 10,376,941 B2
(45) Date of Patent: Aug. 13, 2019

(54) PRESS FORMING METHOD AND TOOL FOR PRESS FORMING

(71) Applicant: NIPPON STEEL CORPORATION, Tokyo (JP)

(72) Inventors: Yasuhiro Wada, Kitakyushu (JP); Shuji Yamamoto, Kitakyushu (JP); Mitsuharu Yamagata, Kitakyushu (JP)

(73) Assignee: NIPPON STEEL CORPORATION, Tokyo (JP)

( * ) Notice: Subject to any disclaimer, the term of this patent is extended or adjusted under 35 U.S.C. 154(b) by 101 days.

(21) Appl. No.: 15/311,883

(22) PCT Filed: May 13, 2015

(86) PCT No.: PCT/JP2015/063750
§ 371 (c)(1),
(2) Date: Nov. 17, 2016

(87) PCT Pub. No.: WO2015/178267
PCT Pub. Date: Nov. 26, 2015

(65) Prior Publication Data

US 2017/0100761 A1 Apr. 13, 2017

(30) Foreign Application Priority Data

May 19, 2014 (JP) ..... 2014-103735

(51) Int. Cl.
*B21D 22/20* (2006.01)
*B21D 22/06* (2006.01)
(Continued)

(52) U.S. Cl.
CPC ..... *B21D 22/20* (2013.01); *B21D 22/06* (2013.01); *B21D 24/00* (2013.01); *B30B 15/0094* (2013.01)

(58) Field of Classification Search
CPC ..... B21D 22/06; B21D 22/20; B21D 22/206; B21D 22/24; B21D 22/26; B21D 22/28;
(Continued)

(56) References Cited

U.S. PATENT DOCUMENTS 8,584,496 B2 * 11/2013 Kuwayama ..... B21D 22/02 72/21.1
2007/0251286 A1 * 11/2007 Baltruschat ..... B30B 11/005 72/179
(Continued)

FOREIGN PATENT DOCUMENTS

CN 102152493 A 8/2011
CN 102567564 A 7/2012
(Continued)

OTHER PUBLICATIONS

WIPO translation of WO 2013002363, Aug. 2008.*
(Continued)

*Primary Examiner* — Pradeep C Battula
(74) *Attorney, Agent, or Firm* — Birch, Stewart, Kolasch & Birch, LLP

(57) ABSTRACT

A press forming method includes a first process of obtaining a pressing force applied to each portion of a tool by an workpiece material during press forming while independently driving the respective each portion of the tool divided into multiple portions and press forming the workpiece material, and a second process of adjusting at least one of an applied driving force, an applied driving speed, and an applied driving timing for each portion of the tool to cause a processing portion of the workpiece material in which the state approaching an overload state is detected based on the pressing force to flow to other processing portions of the workpiece material.

14 Claims, 17 Drawing Sheets

(51) Int. Cl.
*B30B 15/00* (2006.01)
*B21D 24/00* (2006.01)

(58) Field of Classification Search
CPC .... B21D 24/00; B21D 24/005; B30B 15/281; B30B 15/0094
See application file for complete search history.

(56) References Cited

U.S. PATENT DOCUMENTS

| | | | |
|---|---|---|---|
| 2011/0132208 | A1 | 6/2011 | Asakawa et al. |
| 2012/0101616 | A1 | 4/2012 | Sato et al. |
| 2012/0279273 | A1 | 11/2012 | Tsuchiya et al. |

FOREIGN PATENT DOCUMENTS

| | | | | |
|---|---|---|---|---|
| CN | 102764807 | A | 11/2012 | |
| JP | 5-57496 | A | 3/1993 | |
| JP | 8-174075 | A | 7/1996 | |
| JP | 2004-322104 | A | 11/2004 | |
| JP | 2005-186142 | A | 7/2005 | |
| JP | 2005-205438 | A | 8/2005 | |
| JP | 2008-132502 | A | 6/2008 | |
| JP | 2008-149349 | A | 7/2008 | |
| JP | 2008-173686 | A | 7/2008 | |
| JP | WO 2008140122 | A1 * | 11/2008 | ..... B21D 22/02 |
| JP | 2010-115702 | A | 5/2010 | |
| JP | 2010-214381 | A | 9/2010 | |
| JP | 2011-136368 | A | 7/2011 | |
| JP | WO 2013002363 | A1 * | 1/2013 | ..... B21D 22/28 |

OTHER PUBLICATIONS

Chinese Office Action and Search Report dated Dec. 4, 2017, for corresponding Chinese Application No. 201580025771.9, with an English translation of the Chinese Search Report.
International Search Report for PCT/JP2015/063750 dated Jul. 21, 2015.
Suzumura, Journal of the Japan Society for Technology of Plasticity, 2010, vol. 51, No. 594, pp. 9, total 6 pages.
Written Opinion of the International Searching Authority for PCT/JP2015/063750 (PCT/ISA/237) dated Jul. 21, 2015.
Yokoi, Journal of the Japan Society for Technology of Plasticity, 2010, vol. 51, No. 594, pp. 13, total 5 pages.

* cited by examiner

PRESS FORMING METHOD AND TOOL FOR PRESS FORMING

TECHNICAL FIELD OF THE INVENTION

The present invention relates to a press forming method for a workpiece material which is made of steel, and a tool for press forming which is used in the press forming method.

Priority is claimed on Japanese Patent Application No. 2014-103735, filed on May 19, 2014, the content of which is incorporated herein by reference.

RELATED ART

As a method for forming a final product such as a bottomed cylindrical member having a vertical wall portion and a bottom wall portion which is continuous with the vertical wall portion from a plate-shaped material, a cup-shaped intermediate material, or the like, a drawing method is widely used.

For example, Non-Patent Document 1 discloses a method which forms a cylindrical container having a constant inner diameter from a bottom portion to an opening portion, or a stepped cylindrical product having a step portion in which an inner diameter changes on the way from the bottom portion to the opening portion. That is, in general, a method is widely used, in which an intermediate material which is formed into a cup shape from a disk-shaped material in a first process is drawn in a second process again, and the cup-shaped intermediate material is further drawn by the re-drawing method.

In this re-drawing method, the cup-shaped intermediate material formed in the first process is nipped between a die in which the intermediate material is accommodated, and a blank holder which is a cylindrical tool inserted into the inner portion of the intermediate material. In addition, a punch coaxially passing through the inner portion of the blank holder is pushed to be inserted into a columnar space which is formed on the bottom of the die, and a cylindrical protrusion is formed on the bottom wall portion of the cup-shaped intermediate material. However, in this forming method, the material configuring the bottom wall portion of the cup-shaped intermediate material may not be sufficiently fed into the columnar space by the punch. In this case, there are problems that the bottom wall portion of the intermediate material may be broken by the tip angle portion of the punch, and a forming failure due to insufficient supply of a material into the columnar space may occur.

With respect to the above-described problems, in Patent Document 1, Non-Patent Document 1, and Non-Patent Document 2, a method for preventing a forming failure using a tool divided into multiple portions is disclosed. That is, as with the re-drawing method of the related art, the upper edge portion of the intermediate material is pressed by the second punch while the first punch is pushed into the bottom wall portion of the cup-shaped intermediate material so as to form a cylindrical protrusion. According to this method, supply of a material into the periphery of the tip angle portion of the first punch is promoted due to a pressing force by the second punch, and as a result, it is possible to prevent a forming failure due to a material breakage or the like. In addition, Patent Document 2 discloses a method in which forming is not performed on a cup-shaped intermediate material, and a final product is obtained from a plate-shaped material by a single process.

In these forming methods, in order to perform forming in a state where a forming failure does not occur, it is important to maintain the movement speed of each tool divided into multiple portions (for example, first punch and second punch) at an appropriate value. In this case, in consideration of variation in material dimensions before forming, or variation in lubrication states between the tool and the material during the forming, it is preferable to proceed forming while the movement speed of each portion of the tool is suitably corrected to an appropriate value according to the forming progress situation such as filling of the material into the tool.

Patent Documents 3 to 5 disclose a method and a device for measuring a load distribution or a strain amount in a tool during press forming. However, in a forming method which is used in general, forming is only performed while each tool divided into multiple portions moves at a constant speed which is set in advance before shaping starts. Accordingly, the movement speed is not corrected according to the material dimensions or the progress situation of press forming during forming.

PRIOR ART DOCUMENTS

Patent Document

[Patent Document 1] Japanese Unexamined Patent Application, First Publication No. 2004-322104

[Patent Document 2] Japanese Unexamined Patent Application, First Publication No. 2010-214381

[Patent Document 3] Japanese Unexamined Patent Application, First Publication No. 2008-149349

[Patent Document 4] Japanese Unexamined Patent Application, First Publication No. 2008-173686

[Patent Document 5] Japanese Unexamined Patent Application, First Publication No. 2010-115702

Non-Patent Document

[Non-Patent Document 1] Takashi SUZUMURA, JOURNAL OF THE JAPAN SOCIETY FOR TECHNOLOGY OF PLASTICITY, P. 9, vol. 51, No. 594 (2010)

[Non-Patent Document 2] Michiharu YOKOI, JOURNAL OF THE JAPAN SOCIETY FOR TECHNOLOGY OF PLASTICITY, P 13, vol. 51, No. 594 (2010)

DISCLOSURE OF THE INVENTION

Problems to be Solved by the Invention

In the above-described press forming method, if a movement speed ratio between a first punch and a second punch which move independently from each other during forming is not appropriate, a load of any one of the two punches becomes excessive, the load may exceed a forming load limit of the drawing device, and there is a concern that further forming may be impossible.

On the contrary, although both loads of the first punch and the second punch are within the forming load limit of the drawing device, an unfilled portion where the tool is not filled with a material remains, and as a result, there is a concern that a forming failure of a product may occur.

The present invention is made in consideration of the above-described circumstances, and an object thereof is to provide a press forming method and a tool for press forming in which it is not impossible to perform forming if a forming load exceeds a load limit of a press forming device when each portions of a tool divided into multiple portions are operated independently from each other, and a product in which a forming failure due to unfilling the tool with a material does not occur can be stably formed.

Means for Solving the Problem

In order to solve the problem and achieve the object, the inventors investigated a method for ascertaining a material inflow at a predetermined position inside a tool in a non-contact manner. In addition, as an example of the method, the inventor adopted a method which provides a sensor in the tool for measuring deformation of the tool, measures a deformation amount generated in the tool by the sensor, and detects an overload situation of the tool during forming. According to this method, it is possible to prevent the load applied to the tool from excessively exceeding the load limit of the press forming device so as not to be impossible to perform forming, and it is possible to prevent a forming failure of a product associated with the unfilling the tool with a material.

That is, the primary points of the present invention are as follows.

(1) According to an aspect of the present invention, there is provided a press forming method, including: a first process of obtaining a pressing force applied to each portion of a tool by an workpiece material during press forming while independently driving the respective each portion of the tool divided into multiple portions and press forming the workpiece material; and a second process of adjusting at least one of an applied driving force, an applied driving speed, and an applied driving timing for each portion of the tool to cause a processing portion of the workpiece material in which the state approaching an overload state is detected based on the pressing force to flow to other processing portions of the workpiece material.

(2) In the aspect according to (1), in the first process, the pressing force may be obtained based on a deformation amount of the tool generated according to the flow of the workpiece material during press forming.

(3) In the aspect according to (1) or (2), in the second process, whether or not the state has approached the overload state may be determined by whether or not the pressing force exceeds a predetermined threshold value.

(4) In the aspect according to any one of (1) to (3), press forming may be drawing for forming the workpiece material into a cylindrical member having an axis line, and the pressing force may be obtained at multiple locations along a circumferential direction of which the center is the axis line.

(5) In the aspect according to any one of (1) to (3), press forming may be drawing for forming the workpiece material into a cylindrical member having an axis line, and the pressing force may be obtained at multiple locations along an extension direction of the axis line.

(6) In the case of (5), the pressing force may be further obtained at multiple locations along a circumferential direction of which the center is the axis line.

(7) In the aspect according to any one of (1) to (6), the tool may include a die and a punch, and the pressing force may be obtained by a strain sensor which is provided on at least one of the die and the punch.

(8) In the aspect according to any one of (1) to (7), a preliminary process may be performed before the first process, and the preliminary processing may include: a calculation process of obtaining a prediction correspondence relationship between at least one of the driving force, the driving speed, and the driving timing, and the pressing force in which the overload state is not generated, in numerical calculations; a measurement process of measuring the pressing force applied to each portion of the tool by the workpiece material during forming while independently driving the respective each portions of the tool and press forming the workpiece material according to the prediction correspondence relationship obtained by the calculation process, and obtaining a measurement correspondence relationship between the measured pressing force and at least one of the driving force, the driving speed, and the driving timing; and a correction process of obtaining a difference between the prediction correspondence relationship obtained by the calculation process and the measurement correspondence relationship obtained by the measurement process, and correcting the prediction correspondence relationship, in which the first process may be performed according to the corrected prediction correspondence relationship obtained by the preliminary process.

(9) According to another aspect of the present invention, there is provided a tool for press forming including a tool divided into multiple portions in which each portion individually receives a driving force and press forms an workpiece material; in which a sensor which acquires a pressing force which is applied to a forming surface of the tool from the workpiece material during press forming.

(10) In the aspect according to (9), a configuration may be adopted, in which the tool for press forming is used for drawing so that the workpiece material is formed into a cylindrical member having an axis line, and the sensor is provided at multiple locations along a circumferential direction of which the center is the axis line.

(11) In the aspect according to (9), a configuration may be adopted, in which the tool for press forming is used for drawing so that the workpiece material is formed into a cylindrical member having an axis line, and the sensor is provided at multiple locations along an extension direction of the axis line.

(12) In the case of (11), the sensors may be further provided at multiple locations along a circumferential direction of which the center is the axis line.

(13) In the aspect according to any one of (9) to (12), a configuration may be adopted, in which the tool for press forming includes a die and a punch, and the sensor is a strain sensor which is provided on at least one of the die and the punch.

(14) In the case of (13), a detection unit of the strain sensor may be provided at a position at a depth of 5 mm to 50 mm from the forming surface of at least one of the die and the punch on which the strain sensor is provided.

Effects of the Invention

According to the aspect described in (1) of the present invention, after the flow state in the material of the workpiece material in the tool is ascertained based on the pressing force acquired by the first process, it is possible to control the operation of each portion of the tool in the second process. Accordingly, it is not impossible to perform forming if a forming load exceeds a load limit of a press forming device when each portions of a tool are operated independently from each other, and it is possible to perform press forming a product in which a forming failure due to unfilling the tool with a material does not occur.

In the case of (2), since the flow in the material of the workpiece material can be ascertained with favorable responsiveness, even when press forming is performed in a short time, it is possible to secure a time required for controlling the driving of each portion of the tool, and it is possible to accurately perform press forming of the workpiece material.

In the case of (3), it is possible to control the operation of each portion of the tool, when the flow state of the workpiece material during press forming is instantaneously determined.

In the case (4), since pressing forces are obtained at multiple locations along the circumferential direction of which the center is the axis line, it is possible to reliably prevent failed operations due to variation in the flow states of the workpiece material in the circumferential direction.

In the case (5), since pressing forces are obtained at multiple locations along the extension direction of the axis line, it is possible to ascertain the forming process of the workpiece material with higher sensitivity. In addition, an application can be performed, in which data of the pressing forces obtained along the axis line direction is input to a numerical calculation model so that press forming is simulated to increase calculation accuracy.

In the case of (6), since the pressing forces are obtained both along the extension direction of the axis line and the circumferential direction thereof, it is possible to three-dimensionally ascertain the forming process of the workpiece material.

In the case of (7), since the flow of the workpiece material can be ascertained with appropriate sensitivity and responsiveness by the strain sensor, it is possible to more accurately perform press forming of the workpiece material.

In the case of (8), since the first process and the second process can be performed, when at least one of the driving force, the driving speed, and the driving timing is optimized by the preliminary process, it is possible to more accurately perform press forming.

According to the aspect described in (9) of the present invention, it is possible to ascertain the flow state of the material of the workpiece material in the tool based on the pressing force acquired by the sensor. Accordingly, it is not impossible to perform forming if a forming load exceeds a load limit of a press forming device when each portions of a tool are operated independently from each other, and it is possible to control so as to be stably drawn a product in which a forming failure due to unfilling the tool with a material does not occur.

In the case of (10), since the pressing forces can be obtained at multiple locations along the circumferential direction of which the center is the axis line, it is possible to reliably prevent failed operations due to variation in the flow states of the material of the workpiece material in the circumferential direction.

In the case of (11), since the pressing forces are obtained at multiple locations along the extension direction of the axis line, it is possible to ascertain the forming process of the workpiece material with higher sensitivity. In addition, an application can be performed, in which data of the pressing forces obtained along the axis line direction is input to a numerical calculation model so that press forming is simulated to increase calculation accuracy.

In the case of (12), since the pressing forces are obtained both along the extension direction of the axis line and the circumferential direction thereof, it is possible to three-dimensionally ascertain the forming process of the workpiece material.

In the case of (13), since the flow in the material of the workpiece material can be ascertained with favorable responsiveness by the strain sensor, even when press forming is performed in a short time, it is possible to secure a time required for controlling the driving of each portion of the tool, and it is possible to accurately perform press forming of the workpiece material.

In the case of (14), measurement can be accurately performed within a sensitivity range of the strain sensor.

EMBODIMENTS OF THE INVENTION

Each embodiment of a press forming method and a tool for press forming of the present invention will be described below.

In each embodiment, in a drawing method using a press forming device capable of independently operating each portions of the tool divided into multiple portions, after an overload situation of a tool during forming is detected based on output signals corresponding to a deformation amount of the tool measured by a sensor for measuring deformation of the tool using the tool into which the sensor is inserted, a movement speed ratio or the like of each portion of the tool divided into multiple portions is appropriately controlled according to the overload situation.

In addition, according to the control, it is possible to prevent continuous forming from being impossible due to an excessive load exceeding the limit of the press forming device, or it is possible to prevent a forming failure of a product associated with the unfilling the tool with a material. As a result, the inside of the tool is filled with a plate-shaped material, a cup-shaped intermediate material, or the like, and it is possible to obtain a product in which each portion of the material has a predetermined plate thickness and a predetermined shape.

[First Embodiment]

Figure 1A:
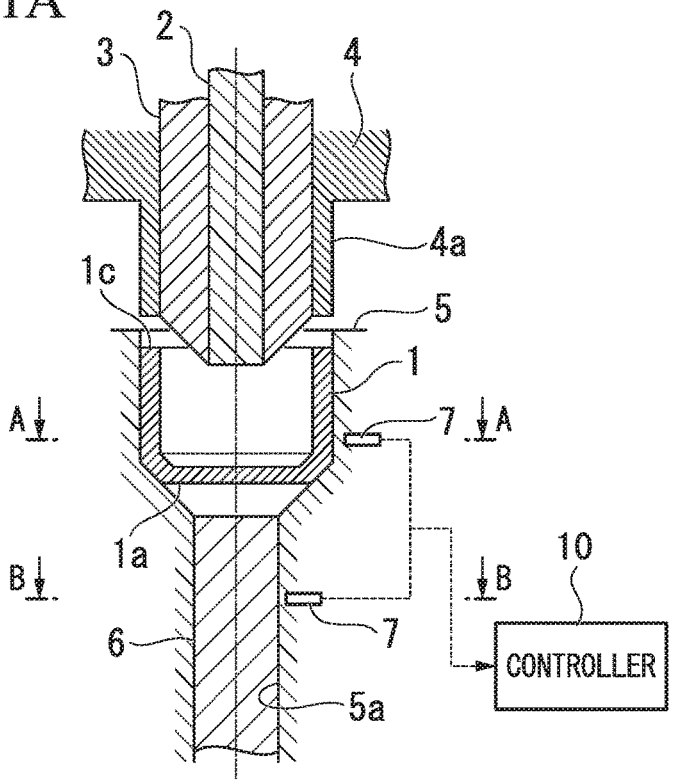
FIG. 1A is a view showing a first embodiment of a press forming method of the present invention, and is a longitudinal sectional view when viewed from a cross section including an axis line of a tool.
Figure 1B:
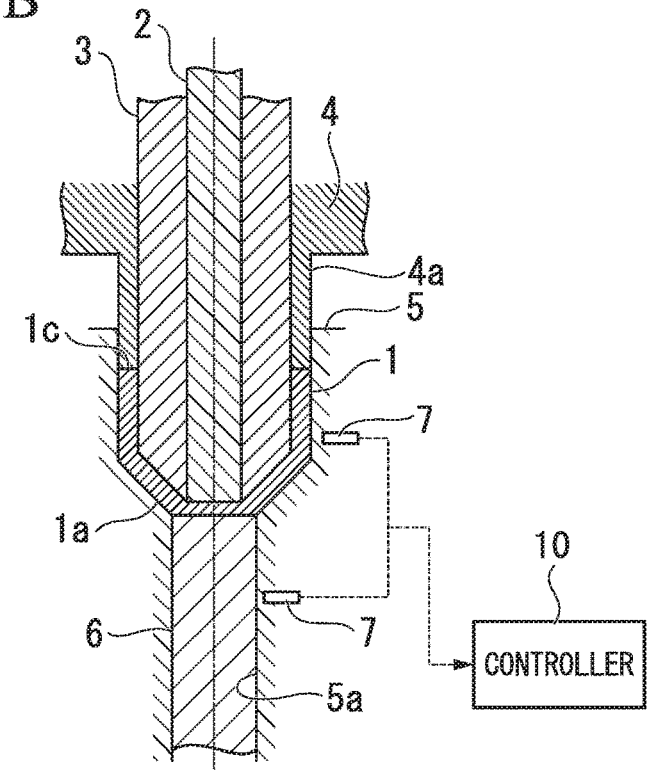
FIG. 1B is a view showing subsequence of the press forming method, and is a longitudinal sectional view when viewed from the same cross section as that of FIG. 1A.
Figure 1C:
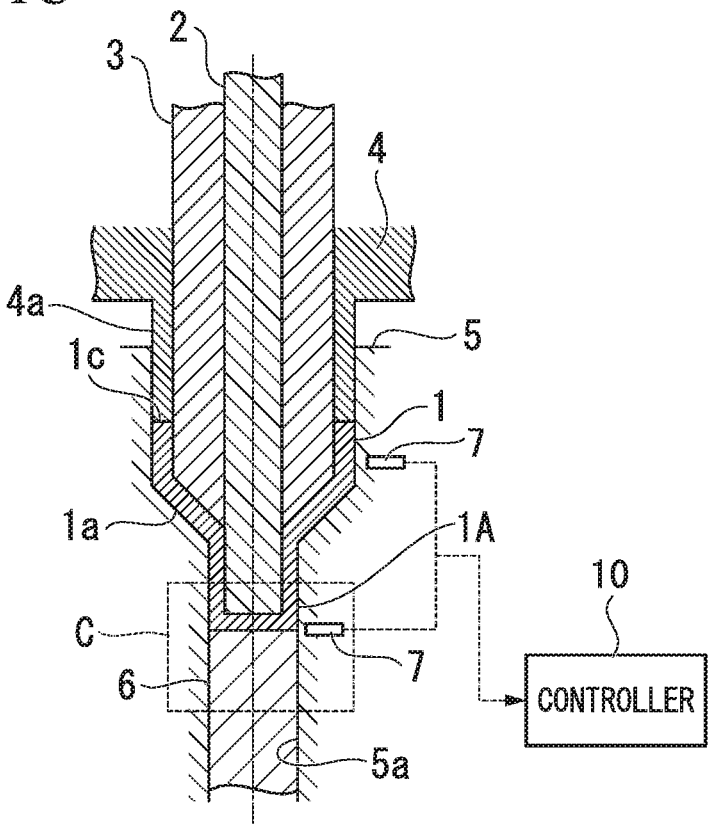
FIG. 1C is a view showing further subsequence of the press forming method, and is a longitudinal sectional view when viewed from the same cross section as that of FIG. 1A.

As shown in FIGS. 1A to 1C, a tool used in a press forming method of the present embodiment includes: a punch 2 which extrudes a bottom wall portion 1*a* of a cup-shaped material 1 (workpiece material) downward; a blank holder 3 which has a tubular shape covering the periphery of the punch 2 and presses the inner surface of the material 1 by the outer circumferential surface of the blank holder 3 during a forming process; an outer circumferential punch 4 which is annularly formed to surround the periphery of the blank holder 3 and in which a protrusion 4*a* pushing an upper edge surface 1 c of the material 1 downward is formed on the lower surface of the outer circumferential punch 4; an annular die 5 which finishes the material 1 in a predetermined external dimension when the material 1 is nipped between the punch 2 and the blank holder 3, which are lowered while pressing the bottom wall portion 1*a* of the material 1 downward; a counter punch 6 which is inserted into a through hole 5*a* which is formed inside the die 5 and presses the bottom wall portion 1*a* of the material 1 when the bottom wall portion 1*a* of the material 1 is nipped between the punch 2 and the counter punch 6.

As described above, among each portion of a tool divided into multiple portions, the movement of each of the punch 2, the blank holder 3, the outer circumferential punch 4, and the counter punch 6 is controlled by a press forming device having a drive mechanism which can individually and independently control the movements of the punch 2, the blank holder 3, the outer circumferential punch 4, and the counter punch 6, as a result, the material 1 is formed in a shape having a predetermined dimension.

Figure 2:
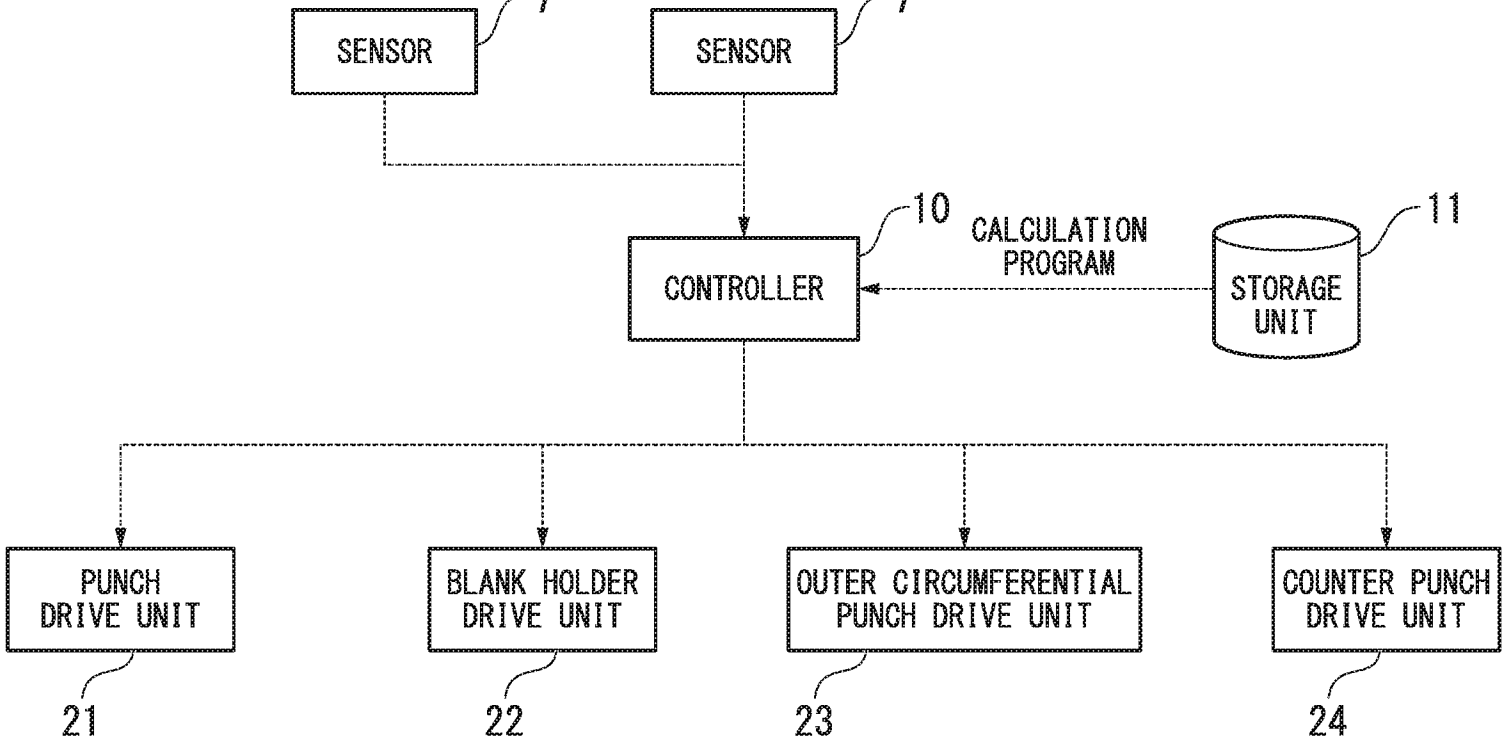
FIG. 2 is a functional block diagram of a press forming device used in the embodiment.

FIG. 2 is a functional block diagram of the press forming device which drives each portion of the tool. A controller 10 reads a calculation program which is stored in a storage unit 11 and controls the drive mechanism of the press forming device. The calculation program is a control program which controls a movement speed or the like of each portion of the tool based on detection results of a sensor 7, and the details thereof will be described below. A CPU (MPU) or the like may be used as the controller 10.

The press forming device of the present embodiment includes a punch drive unit 21, a blank holder drive unit 22, an outer circumferential punch drive unit 23, and a counter punch drive unit 24 as the drive mechanism. The punch drive unit 21 drives the punch 2 based on a drive control signal output from the controller 10. The blank holder drive unit 22 drives the blank holder 3 based on a drive control signal output from the controller 10. The outer circumferential punch drive unit 23 drives the outer circumferential punch 4 based on a drive control signal output from the controller 10. The counter punch drive unit 24 drives the counter punch 6 based on a drive control signal output from the controller 10. Each of the above-described drive control signals includes a speed change signal, a stop signal, or the like. Accordingly, the starts or the stops of the movements of the punch 2, the blank holder 3, the outer circumferential punch 4, and the counter punch 6 are individually controlled. Similarly, the movement speeds or the movement stops of the punch 2, the blank holder 3, the outer circumferential punch 4, and the counter punch 6 are individually changed based on the speed change signals output from the controller 10.

The sensor 7 of the present embodiment is embedded into an assumed portion at which the inside of the tool is filled with the material 1 according to the progress of forming. For example, as shown in FIG. 1B, the portion is disposed at a position corresponding to a portion of the shape parallel to the movement direction of the outer circumferential punch 4, a position (not shown) corresponding to the portion in the vicinity of an inclined surface formed on the tip end of the blank holder 3, a position corresponding to the protrusion 1A described below, or the like.

Accordingly, the position at which the sensor 7 is disposed or the number of the sensors 7 may be appropriately changed according to the shape, the division configuration, or the like of the tool which performs press forming.

A drawing method (press forming method) using the tool and the press forming device having the above-described configuration will be described with reference to FIGS. 1A to 2.

First, the punch 2, the blank holder 3, and the outer circumferential punch 4 are lifted to standby positions having predetermined heights by driving the punch drive unit 21, the blank holder drive unit 22, and the outer circumferential punch drive unit 23.

Subsequently, the cup-shaped material 1 (intermediate material) is inserted from a gap provided between the punch 2, the blank holder 3, and the outer circumferential punch 4, and the die 5 which is positioned at the standby positions, and the cup-shaped material 1 is installed inside the die 5 such that the center axis line of the cup-shaped material 1 approximately coincides with the center axis line of the forming surface inside the die 5. Here, the cup shape is a bottomed cylindrical shape. Thereafter, the punch 2, the blank holder 3, and the outer circumferential punch 4 are integrated, and are lowered toward the material 1 which is disposed inside the die 5. Accordingly, the bottom wall portion 1*a* of the cup-shaped material 1 is nipped and pressed by the upper and lower surfaces of the blank holder 3, the punch 2, and the die 5 between the blank holder 3 and the punch 2, and the die 5, and the outer circumferential punch 4 comes into contact with an upper edge surface 1*c* of the cup-shaped material 1 and is stopped.

In this way, simultaneously with the movements of the punch 2, the blank holder 3, and the outer circumferential punch 4, the counter punch 6 lifts along the through hole 5*a* machined inside the cylindrical die 5, comes into contact with the bottom surface of the cup-shaped material 1, and is stopped. When the operations of each portion of the tool are completed, as shown in FIG. 1B, the cup-shaped material 1 is nipped between the blank holder 3 and the die 5, and between the punch 2 and the counter punch 6 to be pressed, and is fixed to the inside of the die 5.

In addition, when the material 1 is fixed to the inside of the die 5 by pressing the material 1 using the punch 2, the blank holder 3, and the outer circumferential punch 4, the bottom wall portion 1*a* of the material 1 is extruded downward while the punch 2 is further lowered, and the counter punch 6 is also lowered according to the movement. Accordingly, as shown in FIG. 1C, the cylindrical protrusion 1A having an outer diameter which is smaller than the outer diameter of the material 1 is formed on the bottom wall portion 1*a* of the material 1.

Figure 3:
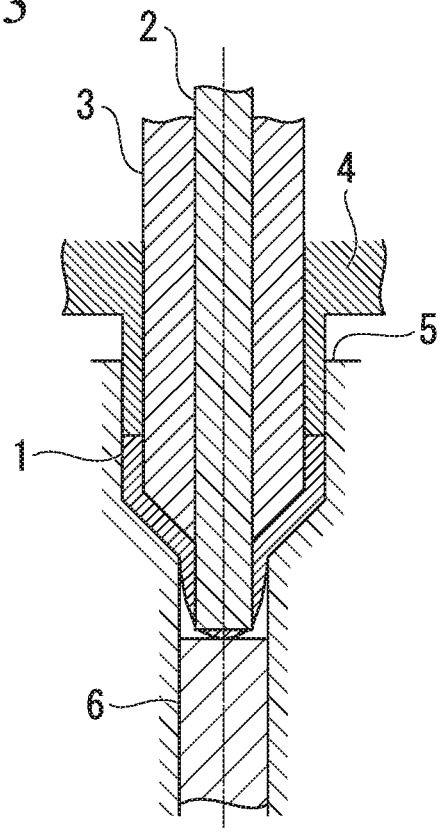
FIG. 3 is a view showing cracks of a tip angle portion of a punch which becomes a problem in drawing, and is a sectional view when viewed from the cross section including the axis line of the tool.

The outer circumferential punch 4 is also lowered during press forming, and the upper edge surface 1*c* of the cup-shaped material 1 is pressed by the protrusion 4*a* to promote inflow of the material 1 inside the die 5. Accordingly, for example, as shown in FIG. 3, breakage of the material 1 on the tip angle portion of the punch 2 is prevented. The material 1 flowing into the die 5 by pressing the upper edge surface 1*c* of the material 1 using the outer circumferential punch 4 is effective to prevent breakage of the material 1 during press forming so as to improve forming limit. However, on the contrary, when the material inflow in the die 5 is locally excessive due to the pressing of the upper edge surface 1*c* of the material 1, loads applied to the outer circumferential punch 4 and the blank holder 3 largely increase, and the load exceeds a load limit (limits of the driving forces of the outer circumferential punch drive unit 23 and the blank holder drive unit 22) of the used press forming device. As a result, it may be impossible to continue press forming.

With respect to the reasons why the forming load largely increases according to the operation conditions of the outer circumferential punch 4 during press forming, the following matters are considered.

In general, before press forming is performed, a gap is provided between the material 1 and the die 5, and a gap is provided between the material 1 and the blank holder 3. If a gap is not provided between the material 1 and the die 5, before the material 1 is installed at a predetermined position inside the die 5, and a fitting state in which the material 1 and the die 5 engage with each other occurs. Accordingly, the material 1 cannot further move, and it is difficult to cause the material 1 to enter the predetermined position.

In addition, when the material 1 is forcibly moved in a state where a sufficient gap is not provided between the surface of the material 1 and the forming surface inside the tool, an uneven contact state may occur, in which only the end portion of the material 1 comes into contact with the tool in a state where the material 1 is inclined with respect to a standard posture. In this state, when the material 1 forcedly moves in the tool, there is a problem that the material 1 or the tool may be damaged. In addition, the force locally applied to the tool excessively increases, damages such as cracks may occur in the tool. In order to avoid the above-described problem, the material 1 which is press formed is designed to have a shape and dimensions in which a predetermined gap can be secured between the material 1 and the forming surface of the tool.

In press forming for obtaining a product having predetermined dimensions and a predetermined shape from the material 1, when the outer circumferential punch 4 is lowered to press the upper edge surface 1*c* of the material 1, the material 1 flows into the die 5, and it is possible to prevent breakage on the tip angle portion of the punch 2. However, when the material 1 is excessively pushed into the die 5 by the lowering of the outer circumferential punch 4, after the gap between the forming surface of the tool and the surface of the material 1 is filled with the material, the pressing by the outer circumferential punch 4 is continuously performed. As a result, the material is further forcibly fed to the portion which is filled with the material and the forming loads which are applied by the outer circumferential punch drive unit 23 and the blank holder drive unit 22 largely increase.

On the other hand, when the material pushed into the die 5 by the lowering of the outer circumferential punch 4 is too small, it is possible to prevent the forming load from increasing. However, the press forming proceeds in a state where a gap remains between the surface of the material 1 and the forming surface of the tool. In this case, the press forming is completed in a state where an unfilled portion which is not filled with the material remains between the press formed product and the tool, and forming failure may occur in the press formed product.

In addition, when the material is not sufficiently supplied into the position around the front end section of the punch 2 inside the tool, and as shown in FIG. 3, breakage in the formed product may occur on the angle portion of the punch 2. Accordingly, in order to form the press formed product in which an unfilled portion does not remain in the tool while preventing the failure of the press forming due to lifting the forming load, it is important that the material is not pushed into a portion of the material 1 in which an overload state is detected during press forming such that the forming load does not increase more than necessary, and the gap between the material 1 and the tool is managed so as to be appropriately maintained such that a gap does not remain between the press formed product and the tool.

In order to review the method for performing press forming while appropriately managing the gap between the material 1 and the tool, the inventors examined by tests how a relationship between the gap between the material 1 and the tool, and the forming load applied to the tool was changed according to the progress of press forming.

That is, first, as shown in FIG. 1A, after the cup-shaped material 1 was installed in the die 5, the press forming device was operated such that the punch 2, the blank holder 3, and the outer circumferential punch 4 were integrally lowered. In addition, as shown in FIG. 1B, the blank holder 3 and the punch 2 came into contact with the bottom surface of the material 1 to be stopped, the outer circumferential punch 4 came into contact with the upper edge surface 1*c* of the cup-shaped material 1 so as to be stopped, and the material 1 was fixed to the inside of the die 5.

Figure 4A:
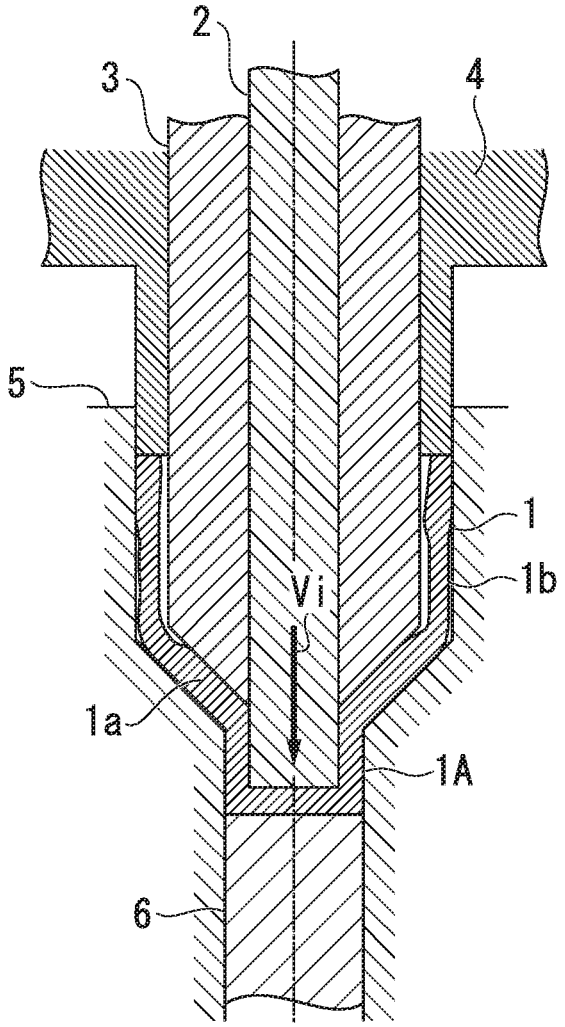
FIG. 4A is a view showing an example of a filling process of a material inside the tool in the press forming method, and is a longitudinal sectional view when viewed from the cross section including the axis line of the tool.

At this time, the gap between the tool and the material 1 was examined in detail. As a result, as shown in FIG. 4A, gaps were hardly confirmed between the upper surface of the bottom wall portion 1*a* of the material 1, and the blank holder 3 and the punch 2, or between the lower surface of the bottom wall portion 1*a* and the counter punch 6. Meanwhile, it was confirmed that gaps were present between the inner circumferential surface of the vertical wall portion 1*b* continuous the bottom wall portion 1*a* of the material 1 and the outer circumferential surface of the blank holder 3, or between the outer circumferential surface of the vertical wall portion 1*b* and the die 5.

Subsequently, when the punch 2 and the counter punch 6 were lowered and the forming of the cylindrical protrusion 1A on the bottom wall portion 1*a* of the material 1 started, in the initial step of press forming, press forming proceeds in the state where a gap is present between the outer circumferential surface of the vertical wall portion 1*b* and the die 5.

Figure 4B:
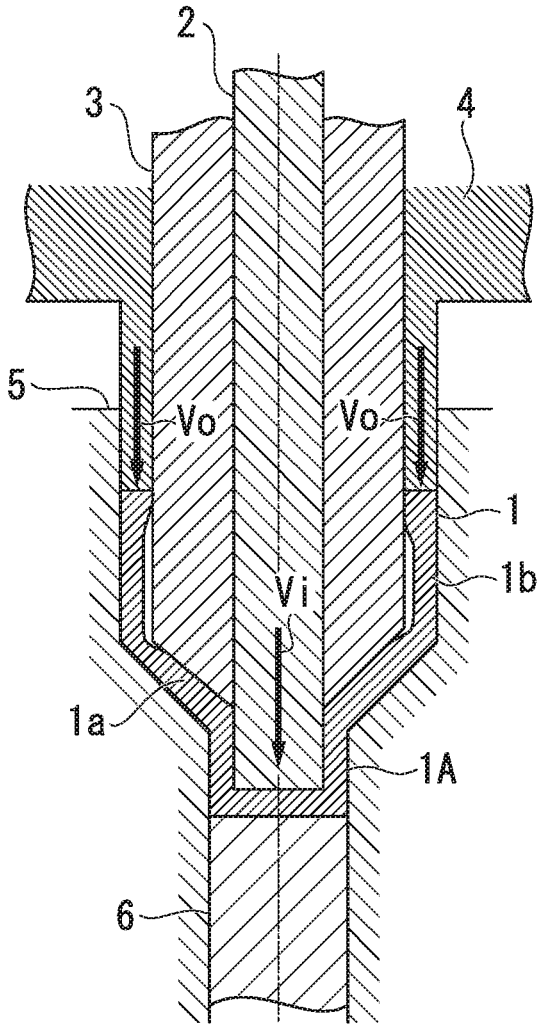
FIG. 4B is a view showing subsequence of the press forming method, and is a longitudinal sectional view when viewed from the same cross section as that of FIG. 4A.
Figure 4C:
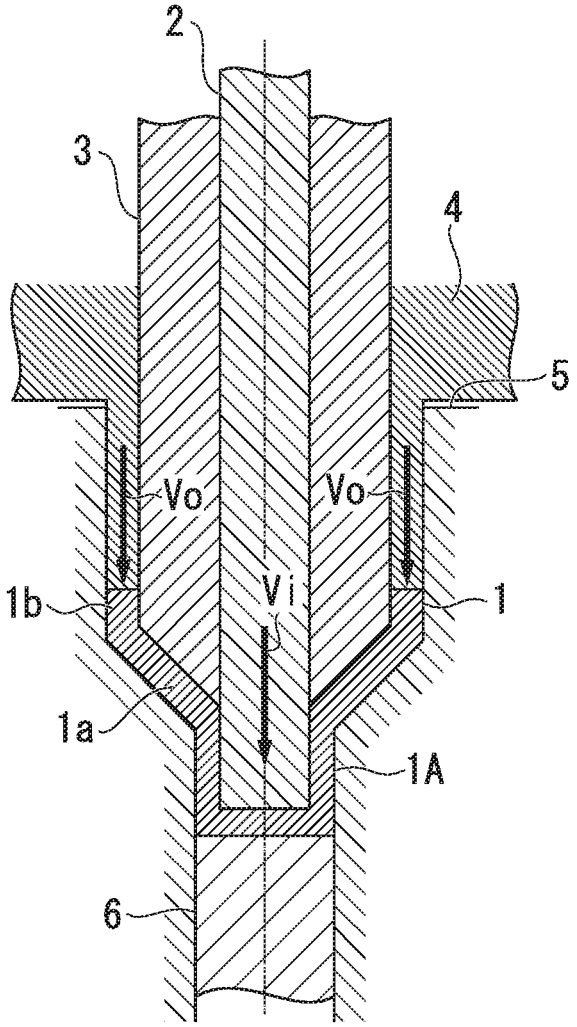
FIG. 4C is a view showing subsequence of the press forming method, and is a longitudinal sectional view when viewed from the same cross section as that of FIG. 4A.

Thereafter, as shown in FIG. 4B, the gap was successively decreased from the upper edge side of the material 1 on the vertical wall portion 1*b* to the bottom wall portion 1*a* side along with the progress of press forming with respect to the protrusion 1A. In addition, finally, as shown in FIG. 4C, an aspect in which the inside of the tool was filled with the material 1 and forming was completed was confirmed.

Next, tests in which a lowering speed of the outer circumferential punch 4 and a lowering speed of the punch 2 were changed relative to each other during press forming were performed.

For example, when the lowering speed of the outer circumferential punch 4 was faster than the lowering speed of the punch 2, a pushing amount of the vertical wall portion 1*b* by the outer circumferential punch 4 was excessively larger than an extension amount of the protrusion 1A by the punch 2. As a result, after the inside of the tool was filled with the material 1 of the vertical wall portion 1*b*, the pushing of the vertical wall portion 1*b* by the outer circumferential punch 4 was continuously performed, and an overload state occurred in which the material was further forcibly pushed into the filled portion of the vertical wall portion 1*b*. As a result, the forming load of the outer circumferential punch 4 exceeded the load capacity of the press forming device, and press forming was interrupted in a state where unfilled portions remained on the protrusion 1A.

On the other hand, the lowering speed of the outer circumferential punch 4 was slower than the lowering speed of the punch 2. Then, the forming load did not exceed the load capacity of the press forming device. However, forming was completed in a state where a gap remained between the material 1 and the tool, and forming failure occurred in the press formed product.

From the above-described results, in order to prevent occurrence of the unfilled portions between the material 1 and the tool and complete press forming in a state where the forming load was not excessive, it was ascertained that a gap filling situation of the material inside the tool which is managed to prevent the following matters was important. That is, in each of the vertical wall portion 1*b* and the protrusion 1A, if the pushing of the material into the die 5 by the outer circumferential punch 4 is continued after when the gap remained in the one of both during press forming and the gap of the other of both was filled with the formed product, the state of the filling portion became an overload state, and the forming load excessively increased. Since the forming load exceeded the load capacity of the press forming device and the forming cannot be continued, it was important to prevent the above-described matters.

In the present embodiment, in order to manage the gap between the formed product and the tool in multiple locations inside the tool during press forming, the sensor 7 for detecting the deformation amount of the tool was incorporated into the tool. In addition, with respect to the deformation of the tool according to filling of the material into the tool during press forming, the overload situation of the tool was detected using signals output from the sensor 7. In addition, a method of controlling the lowering speed of the tool such as the punch 2 to an appropriate value according to the overload situation was adopted. According to this method, the unfilled portions of the material 1 are not generated in the tool, and it is possible to complete forming in a state where the forming load is not excessive and does not exceed the load capacity of the press forming device and the operation of the press forming device is not stopped during forming.

Figure 5:
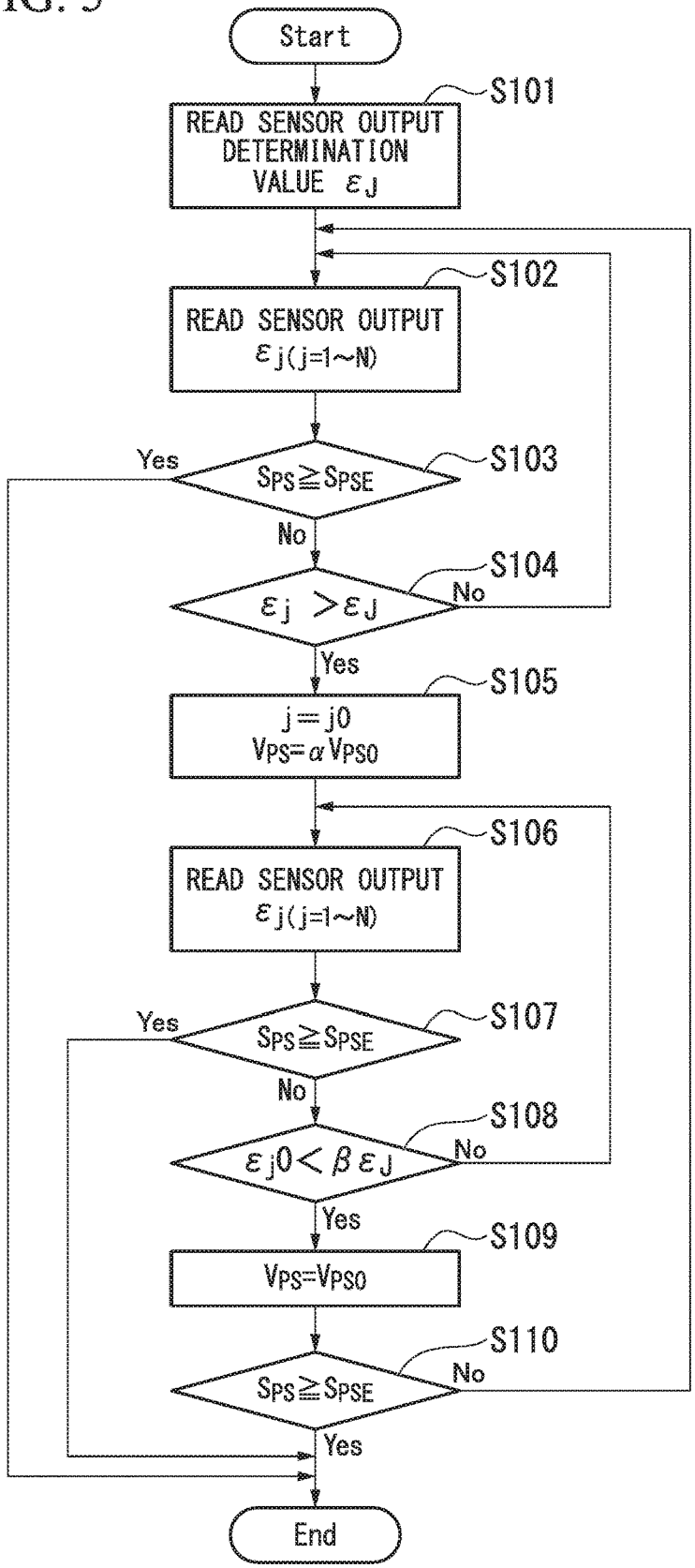
FIG. 5 is a flowchart of a calculation program used to control the press forming device.

A flowchart shown in FIG. 5 shows treatment which is performed by the controller 10 according to a calculation program stored in the storage unit 11 shown in FIG. 2. If the control starts, first, the controller 10 reads a sensor output determination value $\varepsilon_J$, which is preset with respect to the output signal from the sensor 7, from the storage unit 11 (Step S101). Thereafter, the controller 10 sequentially reads sensor outputs $\varepsilon_j$ from the sensors 7 during press forming (Step S102).

Subsequently to Step S102, the controller 10 determines whether or not a stroke $S_{ps}$ when a portion which is determined to a control object in advance among each portions of the tool divided into multiple portions moves reaches a predetermined final stroke $S_{pse}$ (Step S103).

In addition, when it is determined that the stroke $S_{ps}$ reaches the predetermined final stroke $S_{pse}$ (Yes in Step S103), the control ends, and when the stroke $S_{ps}$ does not reach the predetermined final stroke $S_{pse}$ (No in Step S103), the step proceeds to Step S104.

When the controller 10 determines that the sensor output from the sensor 7 does not exceed the sensor output determination value $\varepsilon_J$ (No in Step S104), the controller 10 continuously performs press forming without changing the lowering speed of the tool while sequentially reading the sensor outputs $\varepsilon_j$ from the sensors 7 and returns the treatment to Step S102.

When a signal which exceeds the preset sensor output determination value $\varepsilon_J$ among the sensor outputs $\varepsilon_j$ from the sensors 7 is input (Yes in Step S104), the number j of the sensor 7 is recorded as j0, and among the each portions of the tool divided into multiple portions, a lowering speed $V_{PS}$ of the portion which is determined to a control object in advance is decelerated to a value which is obtained by multiplying a value $V_{PS0}$ set at an initial stage of forming by an arbitrary value $\alpha$ which is separately determined and is smaller than 1 (Step S105).

Thereafter, the controller 10 continuously performs the press forming while sequentially reading the sensor outputs $\varepsilon_j$ from the sensors 7 (Step S106).

In addition, the controller 10 determines whether or not the stroke $S_{PS}$ of the portion which is determined to a control object in advance among the each portions of the tool divided into multiple portions reaches the predetermined final stroke $S_{PSE}$ (Step S107), and in a case where the stroke $S_{PS}$ reaches the predetermined final stroke $S_{PSE}$ (Yes in Step S107), the control ends.

When the output signal $\varepsilon_{j0}$ from the sensor 7 having the number j=j0 transmitting the signal exceeding the preset sensor output determination value $\varepsilon_J$ is smaller than a value obtained by multiplying the sensor output determination value $\varepsilon_J$ by an arbitrary value $\beta$ which is smaller than 1 (Yes in Step S108) before the stroke $S_{PS}$ of the portion which is determined to a control object in advance among the each portions of the tool divided into multiple portions reaches the predetermined final stroke $S_{PSE}$ (No in Step S107), the lowering speed $V_{PS}$ of the portion which is determined to a control object in advance is corrected to the value $V_{PS0}$ set at the initial stage of forming again, and the forming is continued. The above-described operations are repeated (No in Step S110) until the stroke $S_{PS}$ of the portion which is determined to a control object in advance among the each portions of the tool divided into multiple portions reaches the predetermined final stroke $S_{PSE}$.

For example, in a case where the output value from the sensor 7 and the determination value corresponding to the predetermined overload state are compared with each other during the forming and the output value from the sensor 7 exceeds the determination value, the movement speed of one portion or the multiple portions among the each portions of the tool divided into multiple portions is corrected to a value in which the output value from the sensor 7 does not exceed the predetermined determination value.

According to the correction of the movement speed, the material viscously flows from the thickened portion of the material 1 in which the overload state is detected to other portions in which the state is not the overload state. In addition, according to proceeding of the flow of the material, the output value of the sensor 7 is gradually decreased. When the output value from the sensor 7 is lower than the predetermined determination value, the movement speed of each portion of the tool is adjusted such that the output value of the sensor 7 increases again.

A relationship between the filling situation of the material in the tool and the output signal from the sensor 7 may be separately obtained by test or the like according to the shape of the used tool.

For example, as the determination value which is compared with the output signal from the sensor 7 so as to determine whether or not the correction is added to the movement speed of the tool during forming, the output values of the sensors 7 in the forming process, when the press forming normally ends in a state where problems such as load excess in a general production do not occur are sequentially accumulated, and the maximum value of the accumulated data being used as the determination value may be considered. In addition, an another test with respect to press forming is performed, and a value at the time of overload which is obtained based on the relationship between the forming situation of the press formed product inside the tool and the output value of the sensor 7 can be used as the determination value.

Moreover, a numerical calculation such as a finite material method is performed, and a calculation value corresponding to the output of the sensor 7 which is assumed to be obtained, when the inside of the tool is filled with the material 1 can be used as the determination value.

In addition, before actual press forming is performed, preliminary processes including a calculation process, a measurement process, and a correction process described below are performed in advance, and the actual press forming may be performed according to the corrected prediction correspondence relationship (described below) obtained by the preliminary process.

In the calculation process, a prediction correspondence relationship between at least one of the driving force, the driving speed, and the driving timing applied to each portion of the tool, and the pressing force by which the overload state is not generated is obtained by a numerical calculation such as a finite material method.

In the measurement process, while the each portions of the tool are independently driven according to the prediction correspondence relationship obtained by the calculation process and the material 1 is press formed, the measurement correspondence relationship between the pressing force obtained by actually measuring the pressing forces applied to the each portions of the tool by the material 1 during the forming using the sensor 7 and at least one of the driving force, the driving speed, and the driving timing is obtained.

In the correction process, a difference between the prediction correspondence relationship obtained by the calculation process and the measurement correspondence relationship obtained by the measurement process is obtained, the prediction correspondence relationship is corrected, and a corrected prediction correspondence relationship is obtained.

The method for obtaining the determination value is exemplified as described above. However, determination values obtained by other methods may be used.

Hereinafter, with reference to a press forming method shown in FIGS. 6A and 6B, an example of the application method of the present invention will be described.

Figure 6A:
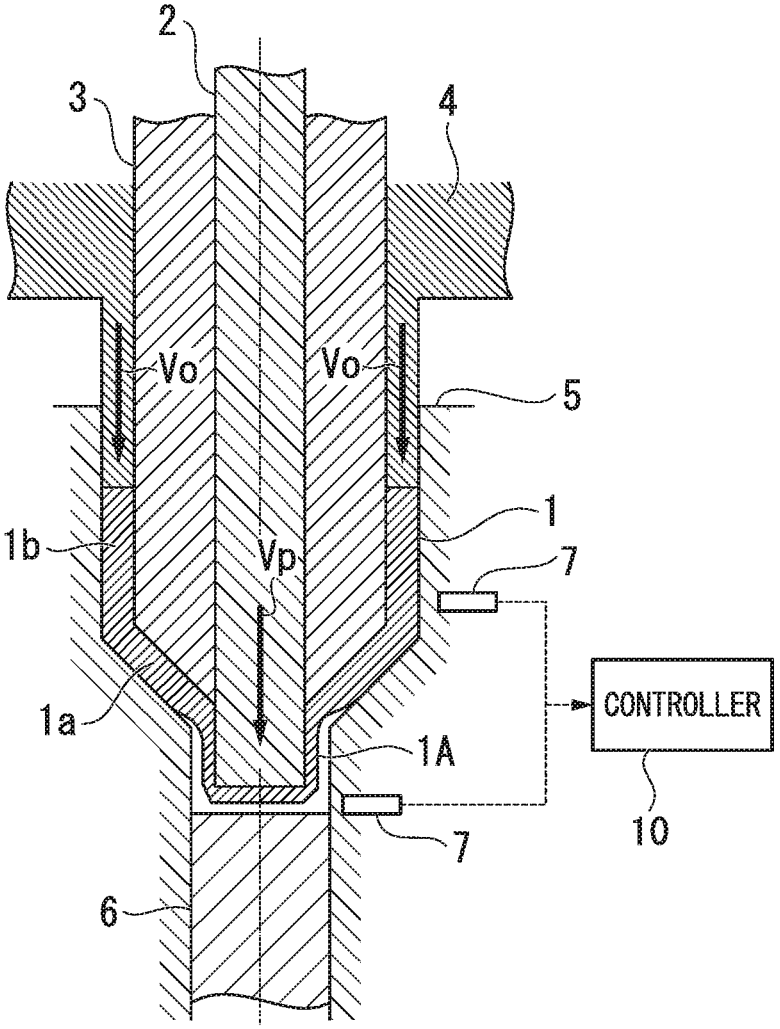
FIG. 6A is a view showing disposition of a sensor of the tool for press forming used in the embodiment and the press forming method using the sensor, and is a longitudinal sectional view when viewed from the cross section including the axis line of the tool.

As shown in FIG. 6A, in a process in which the outer circumferential punch 4 and the punch 2 are lowered and press forming proceeds, the inside of the tool is filled with the material 1 in the vertical wall portion 1*b* in a state where a gap remains between the outer circumferential surface of the protrusion 1A formed on the bottom wall portion 1*a* of the cup-shaped material 1 and the inner circumferential surface of the die 5, and deformation occurs in this portion of the tool (die 5). The signal is emitted from the sensor 7 provided at the position corresponding to the vertical wall portion 1*b* inside the die 5 according to the deformation. When this signal exceeds a predetermined determination value, the movement speed of each portion of the tool is corrected such that the deformation of the tool in the vicinity of the sensor 7 is decreased by a calculation program which controls the operation of the tool such as the punch 2 based on the signal, and forming is continued.

That is, for example, while the lowering speed $V_p$ of the punch 2 is constantly held or is increased, the lowering speed $V_0$ of the outer circumferential punch 4 is slower than the lowering speed $V_p$. As a result, the material inflow of the material 1 from the vertical wall portion 1*b* to the protrusion 1A is promoted by the pulling of the punch 2, and it is possible to prevent the forming from being stopped due to the forming load exceeding the load capacity of the press forming device while decreasing the load applied to the outer circumferential punch 4 by alleviating the excessive filling of the material in the vertical wall portion 1*b* so as to prevent the increase in the forming load.

That is, in a case where the filling of the vertical wall portion 1*b* proceeds in a state where the protrusion 1A of the press formed product is unfilled during the forming, the signal indicating the overload exceeding the determination value is detected by only the sensor 7 of the vertical wall portion 1*b*. In this case, the bottom wall portion 1*a* is drawn downward by the pressing of the punch 2 to alleviate the filling of the vertical wall portion 1*b* while the lowering speed of the outer circumferential punch 4 is decreased so as to eliminate the overload state, and the material inflow into the bottom wall portion 1*a* is promoted. As a result, it is possible to advance the forming in a state where the vertical wall portion 1*b* is not overfilled with the material. Moreover, if the signal from the sensor 7 at the position corresponding to the vertical wall portion 1*b* is less than or equal to the determination value, it is possible to promote the filling of the material into the tool by increasing the lowering speed of the outer circumferential punch 4.

Thereafter, if the signal exceeding the determination value is output from the sensor 7 again, local filling of the material occurs in the vertical wall portion 1*b*, and it is detected that the state is overload state, the lowering speed of the outer circumferential punch 4 is decreased again so as to alleviate the overload state in the vertical wall portion 1*b*.

Figure 6B:
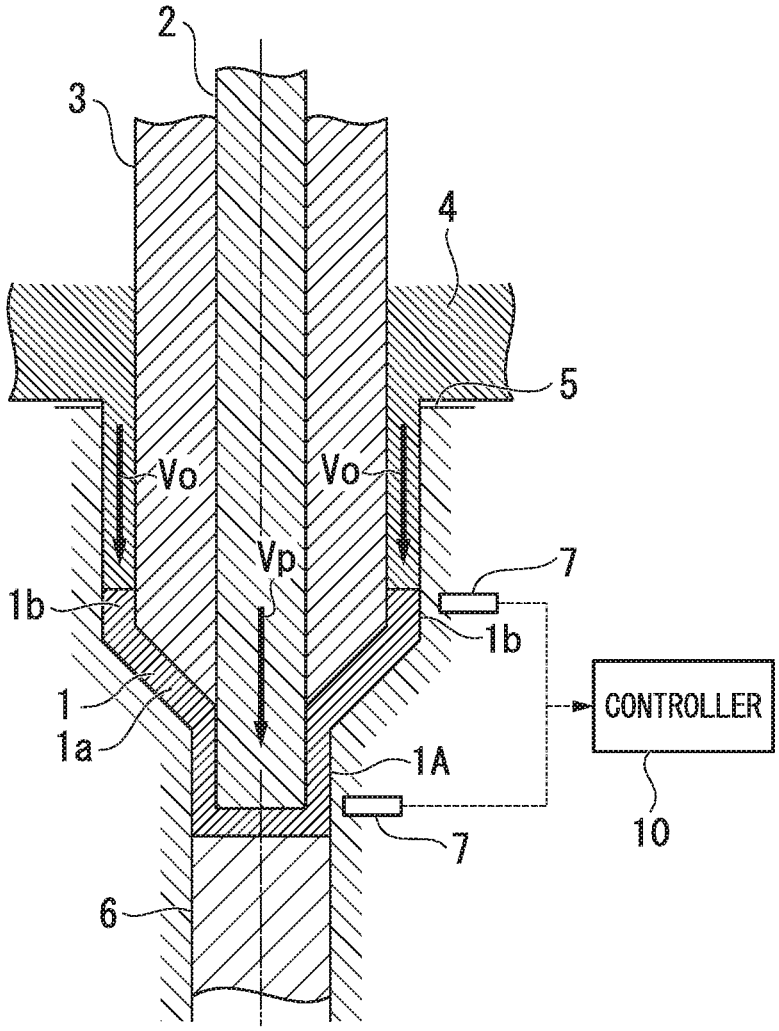
FIG. 6B is a view showing subsequence of the press forming method, and is a longitudinal sectional view when viewed from the same cross section as that of FIG. 6A.

By repeating the control of the operation of the tool based on the output signal from the sensor 7, as shown in FIG. 6B, the inside of the tool is filled with the material 1 and the press forming is completed without the forming stopping due to the forming load exceeding the load capacity of the press forming device.

Figure 7A:
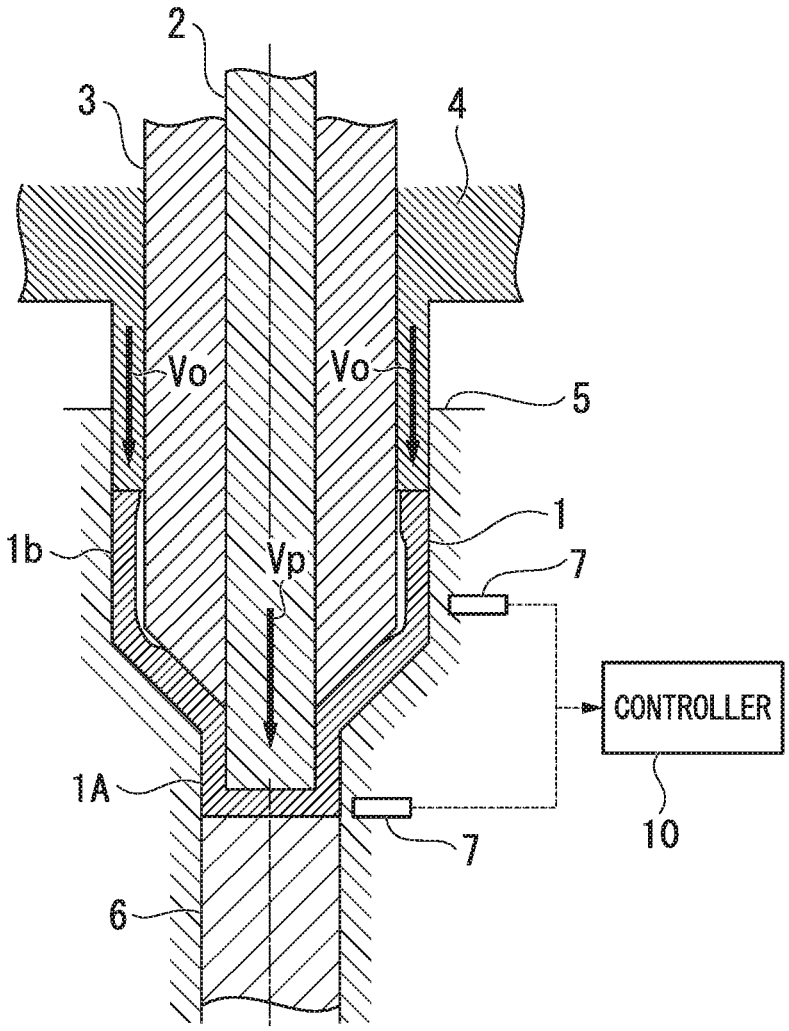
FIG. 7A is a view showing the press forming method of the embodiment, and is a longitudinal sectional view when viewed from the cross section including the axis line of the tool.
Figure 7B:
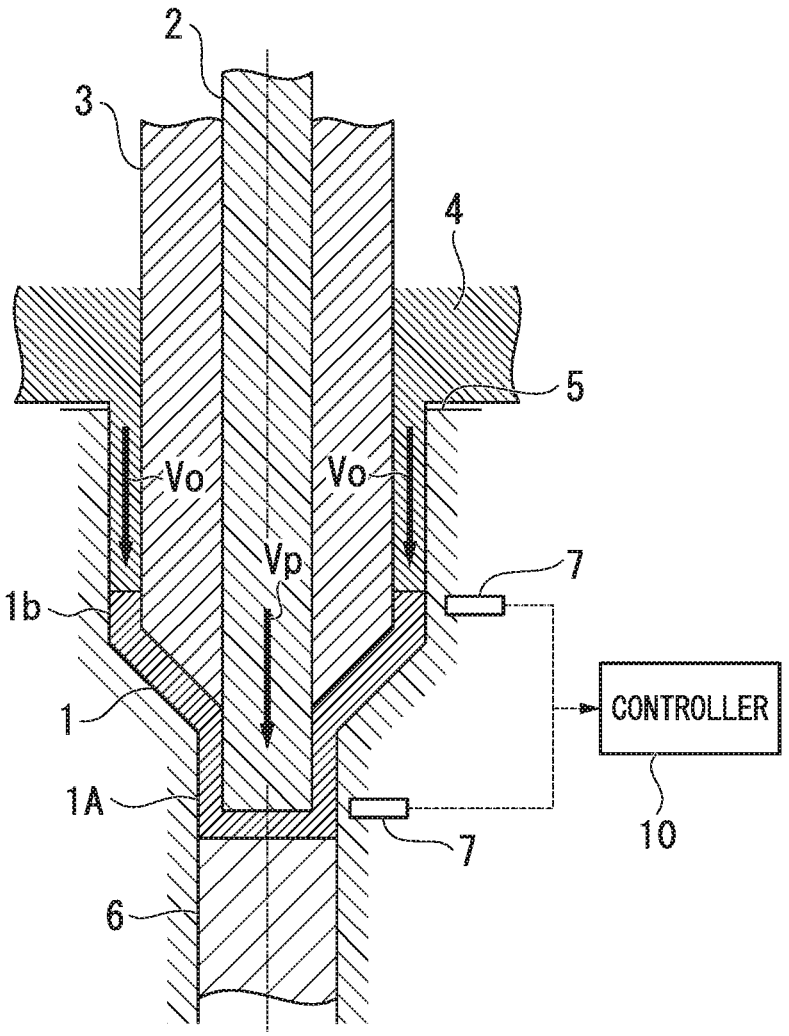
FIG. 7B is a view showing the subsequence of the press forming method, and is a longitudinal sectional view when viewed from the same cross section as that of FIG. 7A.

On the other hand, as shown in FIG. 7A, when the protrusion 1A of the material 1 is filled with the material, the portion of the tool corresponding to the filled portion is deformed. The deformation is detected as a signal exceeding the determination value by the sensor 7 provided at the position corresponding to the tubular portion 1A. Meanwhile, in a case where unfilled portions remain between the vertical wall portion 1*b* and the tool and the signal detected by the sensor 7 is smaller than the determination value, the lowering speed $V_0$ of the outer circumferential punch 4 increases, or the lowering speed $V_p$ of the punch 2 decreases. Alternatively, both are performed or any one of both is performed. As a result, material filling in the portion of the vertical wall portion 1*b* is promoted, the entire tool can be filled with the material, and a product having a predetermined shape shown in FIG. 7B is obtained.

In a case where the vertical wall portion 1*b* is filled with material before the protrusion 1A of the material 1 is press formed in predetermined dimensions, the state becomes the overload state, and the load increases, the relative lowering speed between the outer circumferential punch 4 and the punch 2 is appropriately changed based on the output signal from the sensor 7 according to the deformation of the tool. As a result, occurrence of the unfilled portion in the vertical wall portion 1*b* is prevented, a situation in which the state becomes the overload state and the forming load exceeds the load capacity of the press forming device is prevented, and a product having a predetermined shape is obtained.

In addition, in the embodiment, the relative lowering speed between the outer circumferential punch 4 and the punch 2 is appropriately changed. However, the control element is not limited to the lowering speed, and at least one of the driving force, the driving speed, and the driving timing applied to each portion of the tool can be used. That is, a relative difference between the driving force of the outer circumferential punch 4 and the driving force of the punch 2 may be provided, and a relative difference between the driving timing of the outer circumferential punch 4 and the driving timing of the punch 2 may be provided. In addition, with respect to combination of three elements of the driving force, the driving speed, and the driving timing, the relative difference between the outer circumferential punch 4 and the punch 2 may be provided.

As described above, the gist of the present embodiment is as follows.

The press forming method according to the present embodiment includes: the first process of obtaining the pressing force applied to the die 5 of the tool by the material 1 during press forming using the sensor 7 while independently driving the punch 2, the blank holder 3, the outer circumferential punch 4, and the counter punch 6 which are the tool divided into multiple portions and press forming the material 1; and the second process of adjusting at least one of the applied driving force, the applied driving speed, and the applied driving timing for each punch 2 of the tool and each outer circumferential punch 4 of the tool to cause the press processing portion of the material 1 in which the state approaching an overload state is detected based on the pressing force to flow to other press processing portions of the material 1.

In the first process, the pressing force is obtained based on the deformation amount (strain amount) of the die 5 of the tool generated according to the flow of the material 1 during press forming.

In the second process, whether or not the state has approached the overload state is determined by whether or not the pressing force exceeds the predetermined threshold value (determination value).

Figure 8A:
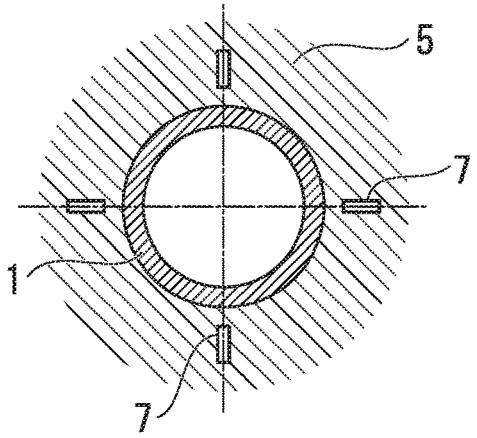
FIG. 8A is a view showing a modification example of the first embodiment, and is a plan sectional view when viewed from an A-A cross section of FIG. 1A.
Figure 8B:
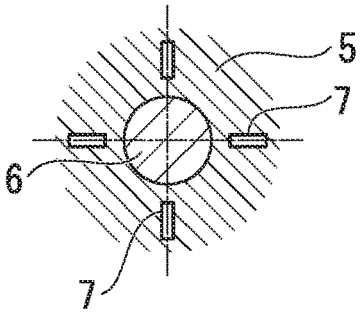
FIG. 8B is a view showing the modification example, and is a plan sectional view when viewed from line B-B of FIG. 1A.

In addition, the press forming is drawing for forming the material 1 into a cylindrical member having an axis line. Moreover, for example, as shown in FIGS. 8A and 8B, the pressing force may be obtained at multiple locations in the circumferential direction in which the axis line is set to a center. That is, in example of FIGS. 8A and 8B, four sensors 7 are disposed in the die 5 at equal intervals of 45° around the axis line at the height position of each of the A-A cross section and the B-B section of FIG. 1A in the die 5.

Figure 9:
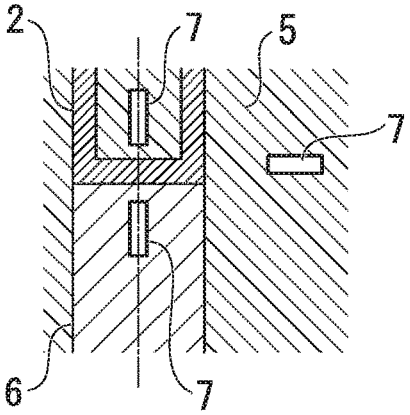
FIG. 9 is a view showing the modification example of the first embodiment, and is a partial sectional view corresponding to a C portion of FIG. 1C.

The present invention is not limited to the aspect in which the pressing force is detected by only the sensor 7 provided in the die 5. An aspect in which the sensor 7 is provided in at least one of the punch 2, the blank holder 3, the outer circumferential punch 4, and the counter punch 6 may be adopted. For example, in an aspect shown in FIG. 9, the pressing force is detected by the sensor 7 provided in the punch 2 and the sensor 7 provided in the counter punch 6 in addition to the sensor 7 provided in the die 5.

Moreover, preferably, the detection unit of the sensor 7 is positioned at a position of a depth of 5 mm to 50 mm from the forming surface of each portion (for example, the die 5, the punch 2, or the like) of the tool on which the sensor 7 is provided. When the detection unit is positioned at the position of the depth of 50 mm or more from the forming surface, since detection sensitivity of the strain amount is rapidly decreased, it is not preferable. On the other hand, when the detection unit is positioned at the position of the depth of 5 mm or less from the forming surface, the sensitivity of the sensor 7 is excessive, and there is a concern that the strain amount cannot be correctly measured.

[Second Embodiment]

Hereinafter, a second embodiment of the present invention will be described. In the second embodiment, differences between the first embodiment and the second embodiment are mainly described, and descriptions with respect to the portions which are the same as those of the first embodiment are omitted.

Figure 10A:
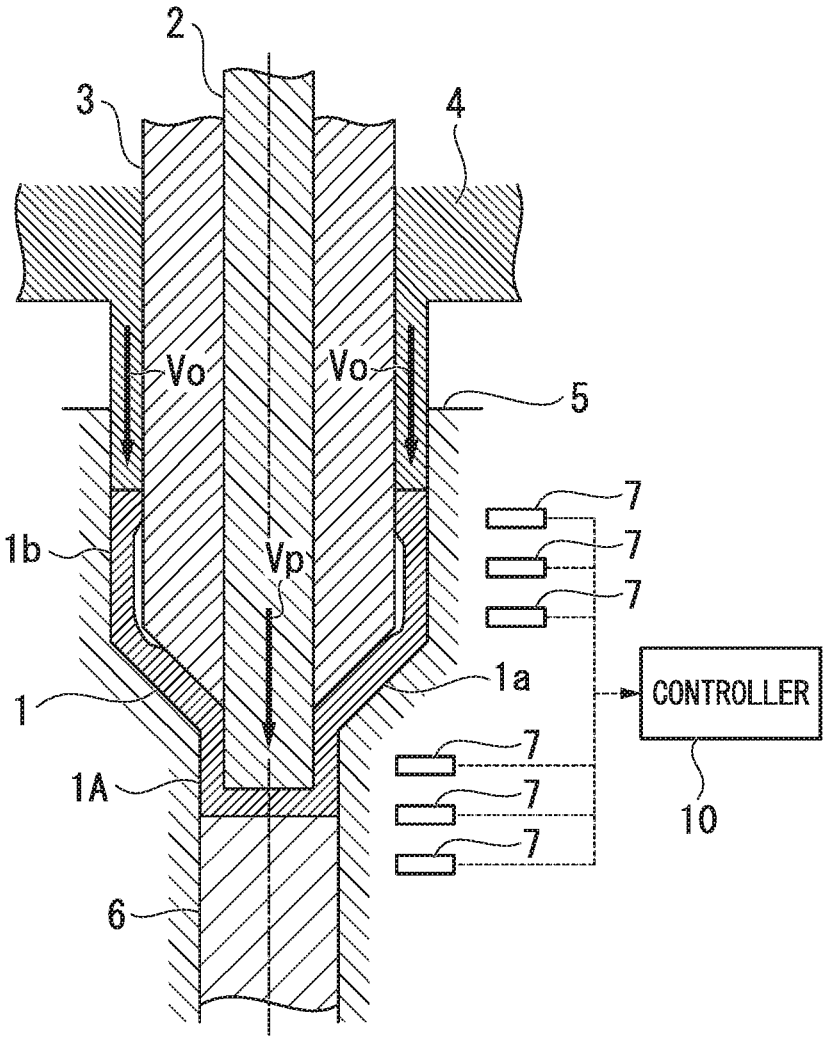
FIG. 10A is a view showing a second embodiment of the press forming method of the present invention, and is a longitudinal sectional view when viewed from the cross section including the axis line of the tool.
Figure 10B:
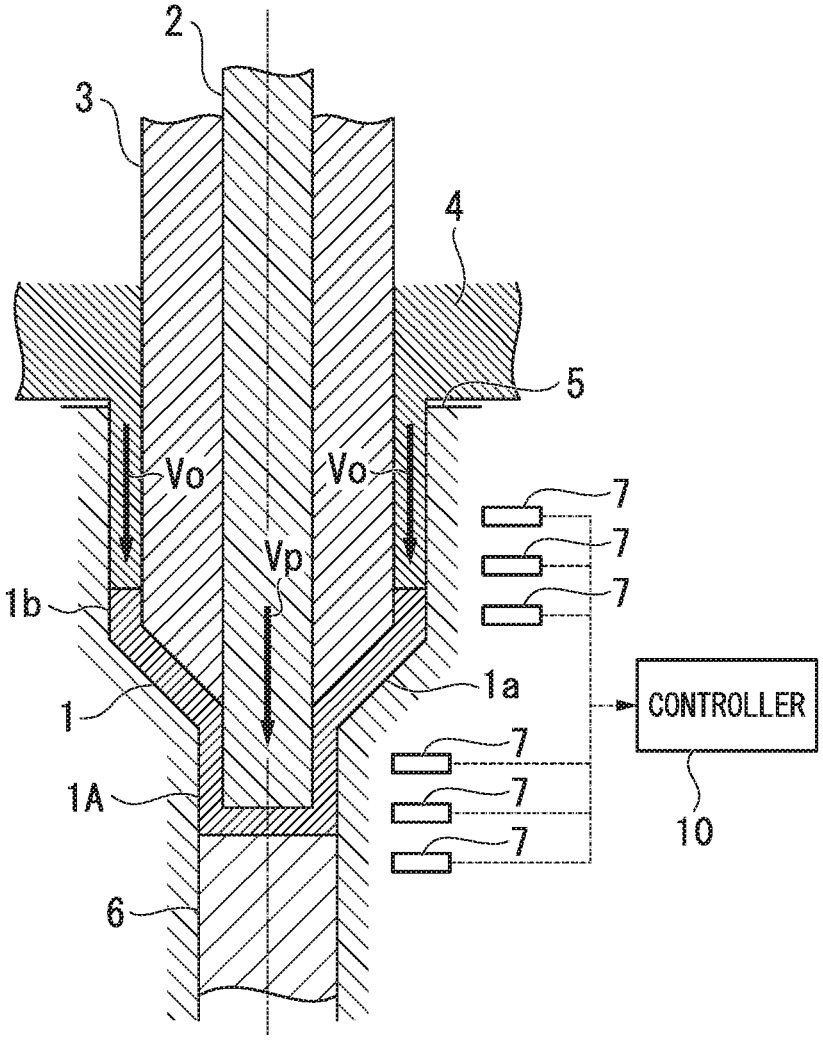
FIG. 10B is a view showing subsequence of the press forming method, and is a longitudinal sectional view when viewed from the same cross section as that of FIG. 10A.

In the present embodiment, as shown in FIGS. 10A and 10B, multiple sensors 7 incorporated into the positions corresponding to each of the vertical wall portion 1*b* and the protrusion 1A are disposed along the axial direction.

As described above, the vertical wall portion 1*b* or the protrusion 1A may not be uniformly filled with the material. For example, as shown in FIG. 10A, the material filling sequentially proceeds from the upper edge portion of the vertical wall portion 1*b* toward the bottom wall portion 1*a*. In addition, when the vertical wall portion 1*b* partially filled with the material is continuously pressed by the outer circumferential punch 4, the state becomes the overload state, and the forming load increases, the forming load is excessive before the entire vertical wall portion 1*b* is filled with the material, and press forming may be completed in a state where unfilled portions remain inside the tool.

Accordingly, since the multiple sensors 7 are disposed, it is possible to control the lowering speed of each of the outer circumferential punch 4 and the punch 2 so as to detect local filling to prevent a partial overload state. In this case, it is possible to more accurately prevent the load increase due to occurrence of the local overload state and decrease the forming load, and it is possible to perform press forming without exceeding the allowable load of the press forming device and allowing the unfilled portions to remain.

For example, as shown in FIGS. 10A and 10B, when local filling proceeds in the tool of the material 1 on the upper end portion of the vertical wall portion 1*b* during forming and a signal detecting deformation of the tool is emitted from the sensor 7 disposed at the position corresponding to the filled portion, by decreasing the lowering speed of the outer circumferential punch 4 or increasing the lowering speed of the punch 2, or performing both, it is possible to alleviate the local filling in the vertical wall portion 1*b*. As a result, the inside of the tool is filled with the material without a load increase due to occurrence of an overload state, and it is possible to obtain a product having a predetermined shape.

Hereinbefore, embodiments of the present invention are described with reference to the drawings. However, the present invention is not limited to only the disclosures of the embodiment.

Figure 11A:
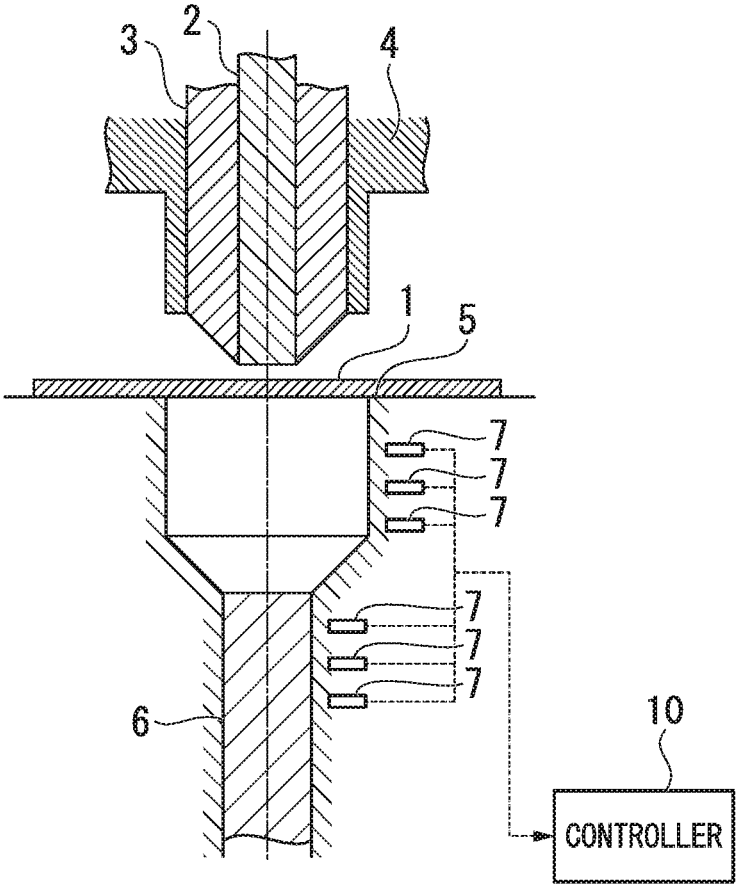
FIG. 11A is a view showing a case where a final product is formed from a disk-shaped material by a single process in the press forming method, and is a longitudinal sectional view when viewed from the cross section including the axis line of the tool.
Figure 11B:
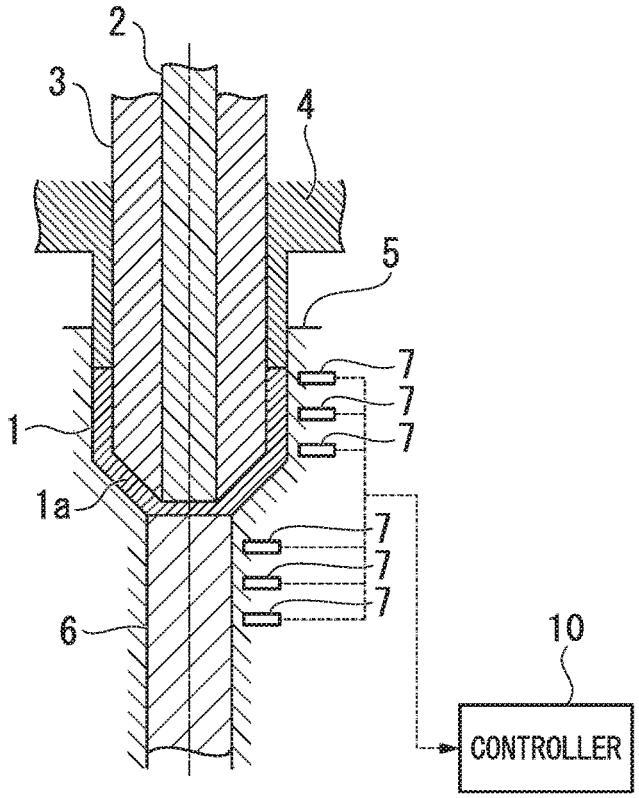
FIG. 11B is a view showing subsequence of the press forming method, and is a longitudinal sectional view when viewed from the same cross section as that of FIG. 11 A.
Figure 11C:
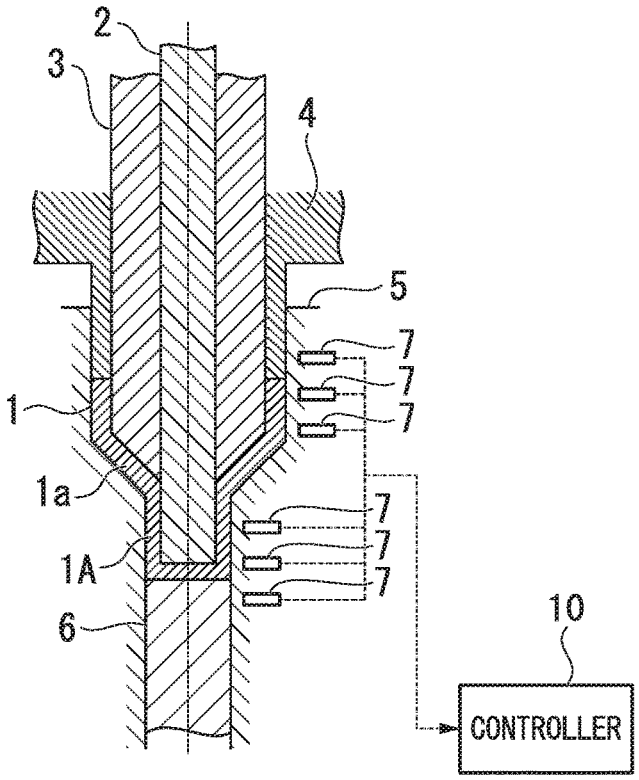
FIG. 11C is a view showing subsequence of the press forming method, and is a longitudinal sectional view when viewed from the same cross section as that of FIG. 11A.

For example, the forming method which is the object of each embodiment is not necessarily limited to only the method which uses the cup-shaped intermediate material shown in FIGS. 1A to 1C. For example, as shown in FIGS. 11A to 11C, the present invention can be applied to a method which forms a final product from a disk-shaped material by a single process.

In addition, in the forming method which is the object of each embodiment, the tool which is divided into multiple portions in which relative speed ratios are controlled is not necessarily limited to only the above-described punch side. The present invention is applied to a dice side (not shown) divided into multiple portions, and can be applied to relative speed controls between the multiple dices and the punch. In addition, each of the dice and the punch is divided (not shown) into multiple portions, and relative speed controls may be performed on each of the dice and the punch.

The shape of the material 1 or the shape of the tool shown in each embodiment is exemplified so as to describe the present invention, and other shapes thereof may be adopted.

In addition, in the above-described embodiments, the strain sensor is used as a unit for detecting the pressing force which is applied to each portion of the tool by the workpiece material. However, ultrasonic waves or magnetic change being used as other methods may be considered.

EXAMPLE

Example 1

According to the forming method shown in FIGS. 1A to 1C, a tubular protrusion 1A having an outer diameter of 23 mm and a thickness of 3 mm was formed on the bottom wall portion 1*a* using a cup-shaped intermediate material having an outer diameter of 48 mm, a plate thickness of 3 mm, and a height of 40 mm which was drawn from a disk-shaped carbon steel material having an outer diameter of 100 mm and a plate thickness of 3 mm. In this time, the sensors 7 were disposed at each positions inside the tool shown in FIGS. 1A to 1C, and strain amounts according to distortion of the tool were measured.

First, for comparison, simple press forming was performed. That is, after press forming proceeded to the state of FIG. 1B, press forming was performed in a state where the lowering speed of the outer circumferential punch 4 was set to a constant value which was 1.4 times the lowering speed of the punch 2. As a result, an overload state occurred in the vertical wall portion 1*b* during press forming, and since the load exceeded the allowable limit of the press forming device, forming was stopped.

Next, press forming was performed in a state where the above-described first embodiment was applied to forming. That is, after forming proceeded to the state of FIG. 1B, the lowering speed of the outer circumferential punch 4 was set to 1.4 times the lowering speed of the punch 2, and thereafter, forming started while measuring the strain amount according to deformation of the tool using each sensor 7 disposed inside the tool. In addition, since the strain signals measured by the sensors 7 disposed at the corresponding positions of the vertical wall portion 1*b* during press forming reached a predetermined determination value, the lowering speed of the outer circumferential punch 4 was decreased by instruction from the controller 10.

Here, as the determination value, in the forming process, when press forming normally ended without problems such as load excess, the maximum value of the output values from the sensor 7 which were accumulated in a general production was used. In addition, when the strain signal reached the determination value, the lowering speed of the outer circumferential punch 4 was decreased from 1.4 times the lowering speed of the punch 2 at the initial stage to 1.0 time the lowering speed of the punch 2.

Thereafter, when the value of the strain signal from the sensor 7 gradually decreased and reached 0.9 times the determination value, the lowering speed of the outer circumferential punch 4 was increased to 1.4 times the lowering speed of the punch 2 at the initial stage by the instruction of the controller 10. As a result, press forming could be completed in a state where the press forming load did not exceed the allowable limit of the forming device.

Example 2

First, for comparison, simple press forming was performed. That is, according to the press forming method shown in FIGS. 11A to 11C, a tubular protrusion 1A having an outer diameter of 35 mm and a thickness of 4 mm was formed on a bottom surface of a cup-shaped member having an outer diameter of 80 mm and a thickness of 4 mm using a disk-shaped stainless steel material having an outer diameter of 150 mm and a plate thickness of 4 mm. In this case, as shown in FIG. 11A, three sensors 7 were disposed on each of the vertical wall portion 1*b* and the protrusion 1A inside the tool, distribution of the strain amounts according to the distortion of the tool was measured with sensitivity. After press forming proceeded to the state of FIG. 11B, forming was performed in a state where the lowering speed of the outer circumferential punch 4 was fixed to 1.2 times the lowering speed of the punch 2. As a result, since the load exceeded the allowable limit of the press forming device during press forming, press forming was stopped.

Next, after the embodiment shown in FIGS. 11A to 11C was applied and press forming proceeded to the state of the FIG. 11B, the lowering speed of the outer circumferential punch 4 was set to 1.2 times the lowering speed of the punch 2, and press forming started while measuring the strain amount according to deformation of the tool using each sensor 7 disposed inside the tool. In addition, since the strain signals measured by the sensors 7 disposed at the vertical wall portion 1*b* during press forming reached a predetermined determination value, the lowering speed of the outer circumferential punch 4 was decreased by instruction from the controller 10.

Here, as the determination value, an output value at the time of an overload was used, which was separately obtained by a press forming test and was obtained from a relationship between the forming situation of the press formed product inside the tool and the output value of the sensor. In addition, when the strain signal reached the determination value, the lowering speed of the outer circumferential punch 4 was decreased from 1.2 times the lowering speed of the punch 2 at the initial stage to 0.9 times the lowering speed of the punch 2.

Thereafter, when the value of the strain signal from the sensor 7 gradually decreased and reached 0.8 times the determination value, the lowering speed of the outer circumferential punch 4 was increased to 1.2 times the lowering speed of the punch 2 at the initial stage by the instruction of the controller 10. As a result, press forming could be completed in a state where the press forming load did not exceed the allowable limit of the forming device.

INDUSTRIAL APPLICABILITY

According to the present invention, it is possible to provide a press forming method and a tool for press forming capable of preventing a load applied to a tool from exceeding a load limit of a press forming device so as to prevent forming not being possible, and of stably drawing a product in which forming failure associated with the unfilling the tool with a material do not occur.

BRIEF DESCRIPTION OF THE REFERENCE SYMBOLS

1: WORKPIECE MATERIAL
2: PUNCH
3: BLANK HOLDER
4: OUTER CIRCUMFERENTIAL PUNCH
5: DIE
6: COUNTER PUNCH
7: STRAIN SENSOR, SENSOR
10: CONTROLLER
11: STORAGE UNIT
21: PUNCH DRIVE UNIT
22: BLANK HOLDER DRIVE UNIT
23: OUTER CIRCUMFERENTIAL PUNCH DRIVE UNIT
24: COUNTER PUNCH DRIVE UNIT

The invention claimed is:

1. A press forming method using a tool including a punch, a die, an outer circumferential punch and a sensor, the method comprising:

a first process of measuring a deformation amount of the die of the tool by the sensor of the tool and obtaining a pressing force applied to the die of the tool by a workpiece material based on the deformation amount during press forming while independently driving each of the punch and the outer circumferential punch of the tool, and press forming the workpiece material; and a second process of detecting that the tool is in a state approaching an overload state based on the pressing force applied to the die of the tool and adjusting at least one of an applied driving force, an applied driving speed, and an applied driving timing for at least one of the punch and the outer circumferential punch of the tool based on the detecting that the tool is in the state approaching the overload state based on the pressing force applied to the die of the tool.

2. The press forming method according to claim 1, wherein in the first process, the pressing force is obtained based on a deformation amount of the tool generated according to the flow of the workpiece material during press forming.

3. The press forming method according to claim 2, wherein in the second process, whether or not the state has approached the overload state is determined by whether or not the pressing force exceeds a predetermined threshold value.

4. The press forming method according to claim 2, wherein press forming is drawing for forming the workpiece material into a cylindrical member having an axis line, and wherein the pressing force is obtained at multiple locations along a circumferential direction of which the center is the axis line.

5. The press forming method according to claim 2, wherein press forming is drawing for forming the workpiece material into a cylindrical member having an axis line, and wherein the pressing force is obtained at multiple locations along an extension direction of the axis line.

6. The press forming method according to claim 2, wherein the pressing force is obtained by a strain sensor which is provided on at least one of the die and the punch.

7. The press forming method according to claim 1, wherein in the second process, whether or not the state has approached the overload state is determined by whether or not the pressing force exceeds a predetermined threshold value.

8. The press forming method according to claim 7, wherein press forming is drawing for forming the workpiece material into a cylindrical member having an axis line, and wherein the pressing force is obtained at multiple locations along a circumferential direction of which the center is the axis line.

9. The press forming method according to claim 7, wherein press forming is drawing for forming the workpiece material into a cylindrical member having an axis line, and wherein the pressing force is obtained at multiple locations along an extension direction of the axis line.

10. The press forming method according to claim 1, wherein press forming is drawing for forming the workpiece material into a cylindrical member having an axis line, and wherein the pressing force is obtained at multiple locations along a circumferential direction of which the center is the axis line.

11. The press forming method according to claim 1, wherein press forming is drawing for forming the workpiece material into a cylindrical member having an axis line, and wherein the pressing force is obtained at multiple locations along an extension direction of the axis line.

12. The press forming method according to claim 11, wherein the pressing force is further obtained at multiple locations along a circumferential direction of which the center is the axis line.

13. The press forming method according to claim 1, wherein the pressing force is obtained by a strain sensor which is provided on at least one of the die and the punch.

14. The press forming method according to claim 1, wherein a preliminary process is performed before the first process, wherein the preliminary processing includes:

a calculation process of obtaining a prediction correspondence relationship between at least one of the driving force, the driving speed, and the driving timing, and the pressing force in which the overload state is not generated, in numerical calculations;

a measurement process of measuring the pressing force applied to the die of the tool by the workpiece material during forming while independently driving at least one of the punch and the outer circumferential punch of the tool and press forming the workpiece material according to the prediction correspondence relationship obtained by the calculation process, and obtaining a measurement correspondence relationship between the measured pressing force and at least one of the driving force, the driving speed, and the driving timing; and a correction process of obtaining a difference between the prediction correspondence relationship obtained by the calculation process and the measurement correspondence relationship obtained by the measurement process, and correcting the prediction correspondence relationship, and wherein the first process is performed according to the corrected prediction correspondence relationship obtained by the preliminary process.

* * * * *